United States Patent [19]

Harrison et al.

[11] 4,115,243

[45] Sep. 19, 1978

[54] SOLVENT DEWAXING PROCESS

[75] Inventors: Charles W. Harrison; Herbert J. Pitman, both of Nederland; Avilino Sequeira, Port Arthur, all of Tex.

[73] Assignee: Texaco Inc., New York, N.Y.

[21] Appl. No.: 813,143

[22] Filed: Jul. 5, 1977

[51] Int. Cl.[2] ..... C10G 43/08
[52] U.S. Cl. ..... 208/33; 208/37
[58] Field of Search ..... 208/33

[56] References Cited

U.S. PATENT DOCUMENTS

| | | | |
|---|---|---|---|
| 3,350,297 | 10/1977 | Torobin | 208/33 |
| 3,850,740 | 11/1974 | Gudelis et al. | 208/33 |

OTHER PUBLICATIONS

Chen et al., "Chemical Engineering" Mar. 19, 1973, pp. 105–111.

*Primary Examiner*—Herbert Levine
*Attorney, Agent, or Firm*—Carl G. Ries; Thomas H. Whaley; Douglas H. May, Jr.

[57] ABSTRACT

A process for dewaxing heavy distillate and residual petroleum oil stocks wherein a waxy oil stock, prediluted with 1–2.5 volumes dewaxing solvent, is cooled to about the depressed cloud point, wherein the cooled, prediluted waxy oil stock is treated with dewaxing solvent, in increments of 0.3–1.5 volumes each to a total dilution of 3.5 to 4 volumes solvent, under conditions of good mixing and cooling at about 1°–8° F/min, to a desired separation temperature for precipitating wax crystals and producing a dewaxed oil.

9 Claims, 1 Drawing Figure

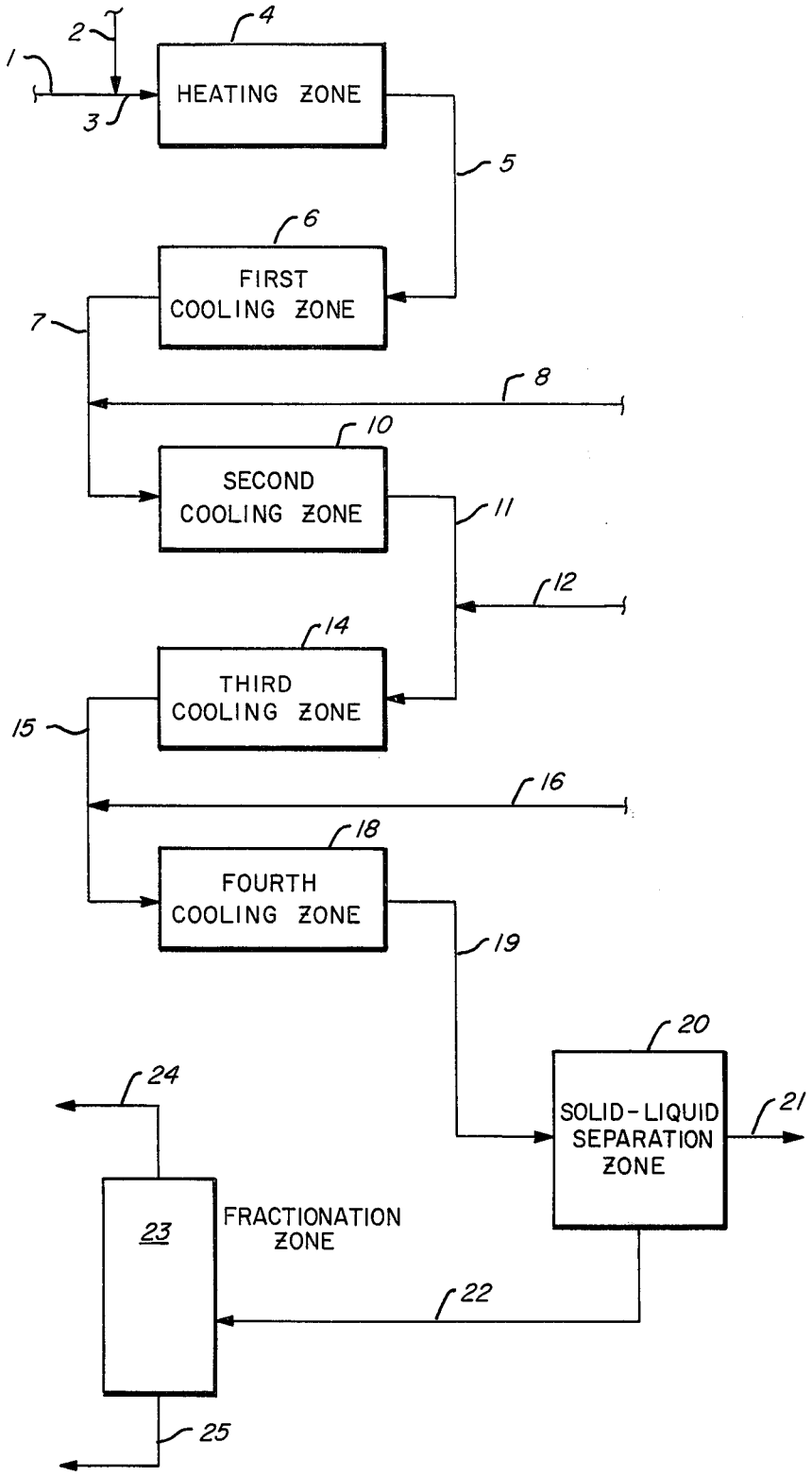
1
2
3
4
HEATING ZONE
5
6
FIRST COOLING ZONE
7
8
10
SECOND COOLING ZONE
11
12
14
THIRD COOLING ZONE
15
16
18
FOURTH COOLING ZONE
19
20
SOLID-LIQUID SEPARATION ZONE
21
22
23
FRACTIONATION ZONE
24
25

SOLVENT DEWAXING PROCESS

BACKGROUND OF THE INVENTION

1. Field of the invention

The present invention relates to a process for dewaxing waxy heavy distillate and residual petroleum oil stocks. More particularly, the invention relates to a solvent dewaxing process wherein the waxy charge stock is prediluted with solvent in an amount equivalent to about 1 to 2.5 volumes of charge, wherein the mixture is cooled to about the depressed cloud point and wherein the mixture is subsequently diluted with solvent in increments equivalent to about 0.3–1.5 volumes of charge each to a total of about 3.5 to 4 volumes solvent per volume oil under conditions of plug flow radial mixing and cooling at a rate of about 1°–8° F./min (0.56°–4.4° C. min), wherein said incremental additions of solvent are at a temperature in the range of about 60°–90° F. (15° to 32° C.) and wherein the diluted oil is cooled at 1°–8° F./min (0.56°–4.4° C./min) to a desired separation temperature for crystalizing wax therefrom.

2. Description of the Prior Art

It is known in the prior art to dewax waxy petroleum oil stocks by cooling oil-solvent solutions at uniformly slow rates, of e.g. 1°–8° F./minute (0.56°–4.4° C./min) under controlled conditions for crystalization of wax from said solutions. Commercially, such oil-solvent solutions are cooled by several methods such as indirect heat exchange in scraped surface exchangers; dilution chilling wherein waxy oil stock is contacted in a multistage tower with chilled solvent under conditions of high levels of agitation (U.S. Pat. No. 3,773,650); and direct chilling, wherein a low boiling solvent, e.g. propylene, mixed with waxy oil stock is vaporized under conditions of reduced pressure.

In such commercial processes, the waxy oil charge, or solutions of waxy oil charge and solvent, are heated to a temperature at which all the wax present is dissolved. The heated charge is then passed into a cooling zone wherein cooling is undertaken at a uniform slow rate in the range of about 1°–8° F./minute (0.56°–4.4° C./min) until a temperature is reached at which a substantial portion of the wax is crystalized, and at which dewaxed oil product has a selected pour point temperature. Upon achieving the desired dewaxing temperature, the mixture of wax crystals, oil and solvent is subjected to solid-liquid separation for recovery of a wax free oil-solvent solution, and a solid wax containing a minor proportion of oil (slack-wax). The separated oil-solvent solution is subjected to fractional distillation for recovery of solvent fraction and product dewaxed oil fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3–6 carbon atoms, $C_2$–$C_4$ range hydrocarbons, $C_6$–$C_7$ aromatic hydrocarbons, halogenated $C_1$–$C_4$ hydrocarbons and mixtures of such solvents. Solvent dilution of waxy oil stocks maintains fluidity of the oil for facilitating easy handling, obtaining optimum wax-oil separation and obtaining optimum dewaxed oil yields. The extent of solvent dilution depends upon the particular oil stocks and solvents used, the approach to filtration temperature in the cooling zone, and the desired final ratio of solvent to oil in the separation zone.

For processes employing indirect cooling in scraped surface exchangers, cooling and wax crystalization is accomplished under conditions of very little agitation at a rate in the range of about 1°–8° F. minute (0.56°–4.4° C./min). Under such conditions, without wall scrapers, wax tends to accumulate on the cold exchanger walls, interfering with heat transfer, and causing increased pressure drop. Thus, scrapers are employed to remove the accumulated wax. Dewaxing solvents are employed to maintain fluidity of the oil in the coolers and chillers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil, resulting in formation of many small wax crystals which are difficult to separate. Under controlled conditions, elongated wax crystals of good size are formed which are easy to separate and which contain little occluded oil.

Dilution chilling processes employ incremental addition of cold solvent, eg. +20° to −25° F. (−6.7° to −32° C.), to the oil under conditions of high degrees of agitation, such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution to facilitate separation of solid wax from the oil-solvent solution. The low boiling hydrocarbon is vaporized from the oil-low boiling hydrocarbon solution under conditions of reduced pressure, at a rate sufficient to cool the solution about 1°–8° F. per minute (0.56°–4.4° C./min). Such cooling is continued until the desired separation temperature and degree of wax crystalization are obtained. At the separation temperature, sufficient low boiling hydrocarbon remains in solution with the oil to provide the desired fluidity for good separation of wax. Agitation of the mixture being cooled is commonly provided for reduction of temperature and concentration gradients.

In these processes of the prior art, rotating mechanical equipment, either scrapers or high speed agitators, conditions, elongated wax crystals of good size are formed which are easy to separate and which contain little occluded oil.

Dilution chilling processes employ incremental addition of cold solvent, eg. +20° to −25° F. (−6.7° to −32° C.), to the oil under conditions of high degrees of agitation, such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution to facilitate separation of solid wax from the oil-solvent solution. The low boiling hydrocarbon is vaporized from the oil-low boiling hydrocarbon solution under conditions of reduced pressure, at a rate sufficient to cool the solution about 1°-8° F. per minute (0.56°-4.4° C./min). Such cooling is continued until the desired separation temperature and degree of wax crystalization are obtained. At the separation temperature, sufficient low boiling hydrocarbon remains in solution with the oil to provide the desired fluidity for good separation of wax. Agitation of the mixing being cooled is commonly provided for reduction of temperature and concentration gradients.

In these processes of the prior art, rotating mechanical equipment, either scrapers or high speed agitators, are employed to facilitate good heat transfer from the oil. Such rotating mechanical equipment is expensive, difficult to maintain, and can contribute to breaking and deformation of wax crystals.

SUMMARY OF THE INVENTION

Now, according to the present invention, we have discovered improvements to continuous solvent dewaxing processes for separating solid wax from heavy wax distillate and/or waxy residual petroleum oil stocks, wherein such a waxy oil stock, predilute with solvent, is heated for dissolving all wax in said oil-solvent mixture, wherein the oil-solvent mixture is treated with additional dewaxing solvent under conditions of cooling at a rate of about 1°-8° F. minute (0.56°-4.4° C./min) to a selected separation temperature in the range of +15° F. to −15° F. (−9° to −26° C.) for forming a slurry of wax crystals in oil solvent solution, wherein said slurry is separated into a dewaxed oil-solvent solution and solid wax, and wherein said separated solution is fractionated to yield a solvent fraction and a dewaxed oil fraction. In a preferred embodiment, the improvement comprises:

(a) continuously prediluting a stream of waxy oil stock with dewaxing solvent in a volume ratio of about 1:1 to 2.5:1 solvent to oil;

(b) heating, in a heating zone, said predilution mixture of solvent and oil to a temperature in the range of about 130° to 180° F. (54° to 82° C.) for melting wax into oil-solvent solution;

(c) cooling, in a first cooling zone, said predilution solution, at a rate of about 1°-8° F./min (0.56°-4.4° C./min) to a temperature about 0°-10° F. (0°-5.6° C.) below the depressed cloud point of the oil-solvent solution under conditions of plug flow radial mixing for precipitating wax from said predilution solution;

(d) mixing, in a second cooling zone, said cooled predilution solution with a first portion of solvent equivalent to about 0.3-0.7 volumes of waxy oil charge, to form a second homogeneous oil/solvent mixture, and cooling the second mixture at a rate of about 1°-8° F./min (0.56°-4.4° F./min) to a temperature in the range of about 50°-100° F. (10° to 38° C.) for precipitating additional wax, wherein said first portion of dilution solvent has a temperature of about 40°-90° F. (4° to 32° C.);

(e) mixing, in a third cooling zone, said oil-solvent mixture from step (d) with a second portion of solvent equivalent to about 0.3-0.7 volumes of waxy oil charge, to form a third homogeneous oil/solvent mixture and cooling the third mixture at a rate of about 1°-8° F./min (0.56°-4.4° F./min) to a temperature of about 10° to 75° F. (−12° to 24° C.) for precipitating additional wax, wherein said second portion of dilution solvent has a temperature of about 40°-90° F. (4° to 32° C.);

(f) mixing, under conditions of plug flow radial mixing in a fourth cooling zone, said oil-solvent mixture from step (e) with a third portion of solvent equivalent to about 0.3-1.5 volumes of waxy oil charge, to form a fourth homogeneous oil/solvent mixture and cooling the fourth mixture at a rate of about 1°-8° F./min (0.56°-4.4° C./min) to a separation temperature in the range of about +15° to −15° F. (−9° to −26° C.) for precipitating additional wax, wherein said third portion of dilution solvent has a temperature of about −20° to 20° F. (−29° to −7° C.);

(g) flowing said fourth mixture of precipitated wax-/oil/solvent from said fourth cooling zone to said solid-liquid separation zone.

Advantages of the present invention over processes of the prior art include elimination of at least a portion of the rotating mechanical equipment (such as wall scrapers and/or agitators from the dewaxing process. Elimination of rotating mechanical equipment reduces cost of constructing solvent dewaxing facilities, and reduces manpower, expense and down time required for operating and maintaining such rotating mechanical equipment.

Plug flow radial mixing in at least the first and fourth cooling zones results in improved heat transfer from the oil-solvent mixture, and reduces operating costs by improving efficiency. However, the greatest advantage is that transverse temperature differentials across the cross-sectional area of flowing oil-solvent solution, is reduced to about 1° F. (0.56° C.) or less, such that substantial subcooling of portions of the oil-solvent solution close to the cold walls of heat transfer equipment is avoided, thus reducing excessive deposition of wax. These advantages, and others will be explained more fully in the detailed description which follows.

BRIEF DESCRIPTION OF THE DRAWING

The drawing is a schematic representation of a solvent dewaxing process employing improvements of the present invention.

DESCRIPTION OF THE TERMS

Heavy waxy petroleum distillate oil stocks and waxy residual petroleum oil stocks are contemplated as charge stocks to the solvent dewaxing process of the present invention. Such waxy heavy distillate petroleum oil stocks have a viscosity greater than 350 SUS at 100° F. and have a boiling range of about 650° F. (345° C.) initial boiling point to about 1050° F. (565° C.) end point. Residual oil stocks have a viscosity greater than about 1200 SUS at 100° F. and have an initial boiling point of about 700+° F. (370° C.). Such waxy petroleum oil stocks may be derived from raw lube oil stocks, the major portion of which boil above 650° F. Such raw lube oil stocks can be vacuum distilled with overhead and side draw distillate streams and a bottom residual oil stock stream. Considerable overlap in boiling ranges of distillate streams and the residual stream may exist, depending upon distillation efficiency. Some heavier distillate streams have almost the same distribution of molecular species as the residual stream. Preferably, paraffinic crude oils are used as sources of lube oil stocks. Such raw lube-oil stocks commonly contain asphaltic materials. Such stocks are generally deasphalted by methods well known in the art, such as propane deasphalting, etc., prior to being used to charge to solvent dewaxing processes.

Such waxy oil stock streams contain aromatic and polar compounds which are undesirable in lubricating oils. Such compounds may be removed, by means such as solvent extraction, hydrogenation, and other means well known in the art, either before or after solvent dewaxing. Treatment of waxy oil stocks for aromatic and polar compound removal before solvent dewaxing reduces the volume of oil to be dewaxed, which concomitantly reduces the amount of solvent employed, heat load, etc.

The wax content of a waxy oil stocks is defined by the amount of material to be removed to produce a dewaxed oil with a selected pour point temperature in the range of +15° to −15° F. (−9° to −26° C.). Wax content of waxy oil stock will vary in the range of 5 to 35 wt. percent. The wax material removed in solvent dewaxing is a complex mixture of straight chain and branched chain paraffins and napthenic hydrocarbons. Waxes in heavy distillate oil stocks and residual oil stocks generally have relatively low crystal growth rates. In solvent dewaxing processes, wax is separated as solid crystals.

Dewaxed oil, as the term is used herein, is the product from the dewaxing process after solid wax and solvent have been removed.

Pour Point is the temperature at which an oil will cease to flow when chilled under prescribed conditions (ASTM-D-97-66). The pour point temperature of an oil stock is reduced in a solvent dewaxing process by removing wax therefrom. The pour point temperature of dewaxed oil determines the useful temperature range of lubricating oil manufactured therefrom, and is indicative of other properties such as viscosity, etc.

The Cloud Point is the temperature at which a cloud or haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type or mixture of solvents employed, etc.

Dewaxing Solvents which may be used in the process of the present invention may be selected from: aliphatic ketones of 3 to 6 carbon atoms; lower molecular weight hydrocarbons e.g. ethane, propane, butanes, and particularly propylene. Aromatic hydrocarbons such as benzene and toluene; halogenated low molecular weight hydrocarbons of 1 to 4 carbon atoms, e.g. dichlorethane, methylene chloride, etc., and mixtures of the above. Useful dewaxing solvent mixtures are: mixtures of methyl ethyl ketone and methyl isobutyl ketone; mixtures of ketones and propylene; mixtures of ketones and $C_6$–$C_7$ aromatic hydrocarbons and mixtures of dichloroethylene and methylene chloride. Particularly useful in the process of the present invention are mixtures comprising 30–70 volume percent methyl ethyl ketone and 70–30 volume percent toluene.

Solvent dilution of waxy oil charge stock, in solvent dewaxing processes, comprises diluting waxy oil charge stock with solvent, in volume ratios in the range of about 1:1 to 5:1 solvent to oil, for improving wax removal from the oil, maintaining fluidity of the oil under cooling, or chilling, conditions in the dewaxing process, obtaining optimum wax separation rates, and obtaining optimum dewaxed oil yields. The extent of solvent dilution is dependent upon the particular waxy oil stock, the solvent system employed, the extent of cooling in the cooling zone, and the desired final viscosity of the wax/oil/solvent mixture going to the wax separation zone. In the prior art it is known that solvent may be added to waxy oil stock before cooling commences, (referred to as predilution); in increments as the oil stock is cooled; at the exit from the cooling zone; or by a combination of the above methods. One solvent may be added at one point in the solvent dewaxing process and another at another point, or the same solvent, or mixture of solvents, may be employed throughout. Generally, it has been observed that addition of a cold solvent (eg. in range of +20° to −25° F. (−7° to −32° C.) to a substantially warmer waxy oil stock, must be accompanied by vigorous agitation for formation of large, easily separated wax crystals. Without vigorous agitation, cold solvent injected into warm waxy oil stock tends to form extremely small wax crystals which are difficult to separate.

Plug Flow radial mixing within contemplation of the present invention refers to mixing the solvent-oil mixture in a tubular mixing zone by splitting the flowing fluid into two or more strata each of which is then helically rotated in one direction about its hydraulic center resulting in radially mixing the flowing fluid such that fluid is forced from the center of the tubular mixing zone outward to the outer wall of the tube, and vice versa, then splitting these strata into two or more additional strata, each of which is then helically rotated in the opposite direction about its hydraulic center, etc. The overall effect of such mixing is to cause the flowing stream to be continuously divided and redivided into strata which are continuously radially inverted, such that elements of the fluid entering at the center of the flowing stream are forced to the outer wall, and vice versa, on a continuous basis. Such radial mixing is accomplished with very little backmixing such that the flow of fluid approximates plug flow. Flow of fluid may be in the laminer range or in the turbulent range, with flow in the turbulent range. In such plug flow radial mixing, transverse gradients from the center to the wall of the mixing zone in temperature, velocity, and composition are substantially reduced or eliminated. Additionally, heat transfer from the body flowing fluid to the wall of the mixer is substantially increased. Mechanical devices to accomplish such plug flow radial mixing may be obtained from Kenics Corporation, and are described in "MOTIONLESS MIXERS FOR VISCOUS POLYMERS", Chen and MacDonald, *Chemical Engineering,* Mar. 19, 1973, p. 105ff. In the present invention, plug flow radial mixing makes three important contributions to the process. Transverse temperature differences across the flowing fluid are reduced to 1° F. (0.56° C.) or less in the cooling zones, such that super cooled oil-solvent mixture does not reside at the cold wall, depositing wax thereon; the flow of oil-solvent mixture is directed at the cold wall, scouring away any wax which may accumulate; and in the mixing zone, solvent and oil are rapidly blended into a mixture having a uniform temperature and composition throughout.

Cooling rate of a waxy oil stock-solvent mixture or solution, in solvent dewaxing processes generally and the process of the present invention particularly, has been observed to be determinate of the size of wax crystals formed in the wax/oil/solvent mixture. Lower cooling rates yield larger, easy to separate crystals, with less oil occluded therein. Conventionally, oil-solvent mixtures are cooled at uniform slow rates in the range of 1°-8° F. per minute (0.56° to 4.4° C./min). Preferably cooling rates are in the range of 1.5°-5° F./min. (0.83° to 2.78° C./min). Although larger wax crystals containing less occluded oil are formed at lower cooling rates, economy demands that the rate be at least about 1° F. per minute (0.56° C.). At cooling rates above about 8° F. per minute (4.4° C. min), the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax crystalization, as new nuclei or as growth of existing crystals, lags as a result of mass transfer, such that the mixture is somewhat supersaturated. Nucleation of new wax crystals is favored over crystal growth at higher degrees of supersaturation which result from higher cooling rates. Thus, the lowest economical cooling rate is to be preferred. When waxy oil stock, or oil-solvent mixtures, are cooled to the cloud point, a very large number of small wax crystal nuclei precipitate, forming a haze or cloud in the mixture. Under conditions of uniform slow cooling, in the 1°-8° F. per minute (0.56°-4.4° C. min) range, these small crystals tend to grow into larger, easily separable crystals at the expense of formation of additional small wax crystal nuclei as the temperature is reduced.

DESCRIPTION OF THE DRAWING

For better understanding the process of the present invention reference is now made to the drawing. The drawing is a schematic representation of a solvent dewaxing process employing improvements of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate an embodiment of the present invention, and are not to be construed as limitations of the invention which is set-out in the claims appended to this application.

In the drawing, heavy waxy petroleum oil stock (waxy oil stock), having physical properties within ranges heretofore set-out in the specification, from line 1 is combined with dewaxing solvent from line 2 in a solvent to oil volume ratio in range of about 1:1 to about 2.5:1. The solvent-oil mixture flows via line 3 into heating zone 4. In heating zone 4, the oil-solvent mixture is heated by indirect heat exchange to a temperature in the range of about 130° to 180° F. (54° to 82° C.) at which all wax present is melted and a first liquid solution results.

In the drawing, heated first oil-solvent solution having all wax dissolved therein, flows from heating zone 4, via line 5, into a first cooling zone 6 wherein first oil-solvent solution is cooled under conditions of plug flow radial mixing to maintain a homogeneous mixture having minimum transverse temperature and concentration gradients, at a cooling rate in the range of about 1°-8° F./minute (0.56°-4.4° C./min) to a temperature of about 0°-10° F. (0° to 5.6° C.) below the depressed cloud point. In the process of the present invention, dewaxing solvent is selected from known dewaxing solvents, as heretofore set-out in this specification. Particularly useful dewaxing solvents are mixtures comprising about 30-70 vol. percent methyl ethyl ketone, 70-30 vol. percent toluene, although other dewaxing solvents such as propylene, mixtures of methyl ethyl ketone and methyl isobutyl ketone, and mixtures of ethylene dichloride and methylene chloride may be used to advantage. The lighter and heavier waxy oil stocks within contemplation of the present invention may require respectively somewhat less or somewhat more solvent for optimum effectiveness. Depressed cloud point temperatures for solvent waxy oil stock solutions within contemplation of the present invention will be in the range of 120° to 170° F. (49° to 77° C.).

In the drawing, the first oil-solvent mixture from first cooling zone 6, having a temperature about 0°-10° F. (0° to 5.6° C.) below the depressed cloud point of the first solution, flows via line 7 to the inlet of second cooling zone 10. A second liquid solvent stream, in an amount equivalent to about 0.3 to 0.7 volumes of waxy oil charge, having a temperature in the range of about 40°-90° F. (4° to 32° C.), is injected into the inlet of second cooling zone 10 via line 8. Preferably, this second liquid solvent is the same composition as the predilution solvent for ease of solvent recovery, although if desired, solvents of different composition may be used throughout the process of the present invention. The second liquid solvent will be at a temperature below the temperature of the first oil-solvent mixture. It has been discovered that direct cooling of waxy oil stock with solvent at a temperature as low as 40° F., according to the process disclosed herein, results in forming wax crystals having very little oil occluded therein. Solvent temperatures above the oil-solvent mixture temperature add heat to the dewaxing process, thus increasing refrigeration requirements.

In the drawing, the first oil-solvent solution in line 7 and second solvent stream in line 8 flow into the inlet of second cooling zone 10 wherein they are mixed to form a homogeneous oil solvent mixture and cooled. Under these conditions of mixing and cooling, wax crystallizes upon existing crystal nuclei or as new crystal nuclei, and the oil forms a solution with solvent. In cooling zone 10 the first homogeneous mixture is cooled at a uniform rate in the range of 1°-8° F./min (0.56° to 4.4° C./min), preferably 1.5°-5° F./min (0.8° to 2.8° C./min). During this cooling step, additional wax precipitates from the oil-solvent solution, decreasing the pour point of oil remaining in solvent solution. A major portion of wax precipitated in second cooling zone 10 accumulates on wax nuclei already formed, causing such wax nuclei to grow into easily separable wax crystals. Cooling in second cooling zone 10 is continued until the temperature of the first homogeneous mixture is reduced to about 50° to 100° F. (10° to 38° C.).

In the drawing, the first homogenous mixture flows from the outlet of second cooling zone 10 via line 11 to the inlet of third cooling zone 14. A third solvent stream, in an amount equivalent to about 0.3 to 0.7 volumes of waxy oil charge, having a temperature in the range of about 40°-90° F.(4° to 32° C.), flows into the inlet of third cooling zone 14 via line 12. In third cooling zone 14 the first homogeneous mixture and third solvent stream are mixed and cooled, forming a second homogeneous mixture of oil-solvent solution and wax crystals. In third cooling zone 14 the second homogeneous mixture is cooled at a uniform rate of 1°-8° F./min (0.5° to 4.4° C./min), and preferably at 1.5°-5° F./min (0.8° to 2.8° C./min) for precipitating additional wax from the oil-solvent solution. Cooling in third cooling zone 14 is continued until the temperature of the second homogeneous mixture is reduced to about 10° to 30° F. (−12° to 1° C.).

In the drawing, second homogeneous mixture flows from the outlet of third cooling zone 14 via 15 to the inlet of fourth cooling zone 18. A fourth solvent stream, in an amount equivalent to about 0.3 to 15. volumes of waxy oil charge, having a temperature in the range of about 0° to 20° F. (−17° to −7° C.) flows into the inlet of fourth cooling zone 18 via line 16. In fourth cooling zone 18, the second homogeneous mixture and fourth solvent stream are mixed by plug flow radial mixing, forming a third homogeneous mixture of oil-solvent solution and wax crystals. In fourth cooling zone 18 the third homogeneous mixture is cooled at a uniform rate of 1°-8° F./min (0.56° to 4.4° C./min), preferably 1.5°-5° F./min (0.8° to 2.8° C./min) for precipitating additional wax from the oil-solvent solution. Cooling in fourth cooling zone 14 is continued to a preselected separation temperature in the range of +15° to −15° F. (−9° to −26° C.) which the oil upon separation from the oil-solvent solution has a pour point in the range of about +20° to −20° F. (−7° to −30° C.).

In the drawing, third homogeneous mixture comprising oil-solvent solution and wax crystals, at the selected separation temperature obtained in fourth cooling zone 18, flows via line 19 to solid-liquid separation zone 20 wherein wax crystals are separated from oil-solvent solution. Solid-liquid separation may be accomplished by solid-liquid separation methods known in the art, such as gravity settling, centrifugal separation, filtration, etc. Preferably, and commonly practiced in commercial processes, wax is separated from oil-solvent solutions by vacuum filtration. That is, wax-oil-solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and commonly wash solvent is sprayed upon the filter cake to displace additional oil. Wash solvent, which may be the same or different from the dewaxing solvent, is likewise pulled through the filter cloth by vacuum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air, or a scraper such as a doctor knife, and the rotating drum carries the filter cloth into the holding tank for contact with additional wax-oil-solvent mixture.

In the drawing, wax from solid-liquid separation zone 20, known as slack wax and containing some oil entrained therein, is recovered via conduit 21 for further refining or for recovery as is. Separated oil-solvent solution, from solid-liquid separation zone 20, flows via line 22 to fractionation zone 23. In fractionation zone 23, the oil-solvent solution is separated into a solvent fraction which is recovered via overhead line 24, and a dewaxed oil fraction which is recovered as product via line 25.

In the process of the present invention, it is contemplated that waxy oil charge stock will be suitable for manufacture of lubricating oils. Thus, a particular waxy oil charge stock will have a boiling range, viscosity, and composition suitable for manufacturing a particular lubricating oil. Solvent dewaxing is performed for removing wax from the waxy charge stock, thereby lowering the pour point temperature to a value suitable for the particular lubricating oil being manufactured. Other refining processes, outside the scope of the present invention, such as solvent extraction, hydrogenation, etc. are commonly performed on the waxy oil charge stock and/or the dewaxed oil for adjusting other properties of the oil, such as viscosity index, to values suitable for the particular lubricating oil.

Production of lubricating oils is relatively low volume operation compared to other petroleum refining operations. Consequently in commercial solvent dewaxing operations it is common practice to process one waxy oil stock at one time and other waxy oil stocks at other times, in blocked out operation.

Heating waxy oil stock and solvent in heating zone 4 is preferably by indirect heat exchange from a heating medium such as steam, hot gas, or other heat transfer fluid to the waxy oil stock. Heating zone 4 may conveniently be a heat exchanger such as a shell and tube exchanger, a double pipe exchanger, etc. Heat is transferred from the heating fluid to the waxy oil stock-solvent mixture primarily by convection. Maximum temperatures necessary for dissolving all the wax in the heavy distillate and residual waxy oil stocks contemplated for processing according to the present invention do not exceed about 180° F. (82° C.) and commonly do not exceed about 160° F. (70° C.). Consequently, heat exchangers having high radiant heat flux, and hot tube walls, such as direct fired heaters, are not preferred for this service.

In second cooling zone 10, third cooling zone 14 and fourth cooling zone 18 homogeneous mixtures of oil-solvent solution and wax crystals are mixed with flowing solvent streams in a series of steps each comprising injection of a portion of solvent into the homogeneous mixtures followed by mixing to thoroughly mix the oil and solvent. Preferably each portion of solvent flow is injected into the homogeneous mixtures as a fine spray of droplets. Such injection improves mixing of the oil and solvent. Preferably, mixing of oil and solvent is by plug flow radial mixing which provides through mixing of oil and solvent without use of rotating mixing equipment. However, in some instances where cooling is by indirect heat exchange with a refrigerant fluid, the walls in second cooling zone 10 and third cooling zone 14 may be so cold that wax freezes to the walls resulting in poor heat exchange and increased pressure drops. Proper selection of refrigerant fluid temperatures can eliminate such problems. Plug flow radial mixing, as previously described, comprises a series of steps wherein the flowing stream to be mixed is divided, and each division is rotated upon its hydraulic axis, forcing liquid from the center of the flowing streams to the outer walls, and liquid from the outer walls to the center. The next succeeding mixing step redivides the streams from the first step into new divisions, each comprising portions of all the streams exiting the first step, and rotates the new divisions in the opposite direction about their hydraulic radius. Thus in each mixing step, each division of the liquid (in this case waxy oil stock and solvent) is mixed, and in the next succeeding step portions of each division are mixed with each other. In order to obtain the degree of mixing desired for waxy oil and solvent in the present process, upon injection of each portion solvent, from about 100,000 to about 1,000,000 divisions and redivisions of the waxy oil and solvent are required. This degree of mixing requires from about 9 to about 20 mixing elements in the plug flow radial mixer following each point of oil injection. The number of mixing elements will be determined by the degree of mixing and the type of mixer selected. Some static mixers which are commercially available divide the flow into two divisions at each step, and some mixers divide the flow into four divisions at each step.

In plug flow radial mixing, a discreet amount of mixing is accomplished by each element at each step. Thus, unlike agitation, where more or less mixing at each stage can be accomplished by increasing or decreasing residence time or agitator speed in that stage, residence time does not contribute substantially to the degree of mixing. In plug flow radial mixing, the liquid to be mixed must pass through a certain number of stages for a certain degree of mixing. In the present invention, relatively rapid mixture of waxy oil into solvent following each injection point in the mixing zone is desirable. As each element of the plug flow radial mixers occupies a length equivalent to about 1.5 diameters of the cooling zone, and as cooling zones for commercial scale solvent dewaxing units may conveniently be about six inches (15.24 cm) in diameter, a minimum velocity of about 0.5 ft/sec (0.15 m/sec) for solvent and oil in the mixing zone is desirable. Stated in a more generalized way, the preferred minimum velocity of solvent and oil in the cooling zone is equivalent to about one cooling zone diameter per second.

A maximum to the flow velocity of waxy oil and solvent in the cooling zone is also desirable. This maximum is preferably equivalent to about 8 cooling zone diameters per second. That is, about 4 ft/sec. (1.22 m/sec) for a 6 inch (15.24 cm) diameter. Upon injection of solvent into the warmer homogeneous mixture, small regions of temperature and concentrationdiscontinues develop, which are equilibrated as the oil and solvent are thoroughly mixed. In some regions of the cooling zones, wax nuclei will form, while in otherregions wax will remain in solution. As the oil and solvent are mixed in the cooling zones and the temperatures and concentrations equilibrate, some of the lower melting point wax nuclei formed in the cooler regions will melt and some wax from the warmer precipitate.

Cooling in the various cooling zones is preferably via indirect heat exchange with a refrigerant fluid, preferably in double pipe heat exchangers. Although, direct heat exchange with a vaporizing low boiling solvent, eg. propylene, may be employed, if desired. Double pipe heat exchangers employed as coolers for chillers, are preferably equipped with stationary plug flow radial mixers. Plug flow radial mixing of the wax-oil-solvent mixture in the cooling zones reduces transverse temperature differentials across the flowing mixture to about 1° F. or less, such that super cooling of the mixture at the cold wall, and concomitant precipitation of low melting point wax, are avoided. Precipitation of low melting point wax, in a cold zone near the cold wall produces two undesirable effects. The low melting point wax, when exposed to warmer oil-solvent mixture becomes tacky or sticky. This sticky wax then tends to stick to the wall of the exchanger, contributing to wax build-up, decreased heat exchanger rates, increased pressure drops, etc. Also, the sticky wax tends to agglomerate into irregular shaped larger particles containing substantial amounts of occluded entrained oil, thereby contributing to decreased dewaxed oil product yields. As stated above, plug flow radial mixing of the wax-oil-solvent mixtures in the cooling zones eliminates cold zones at the walls of the heat exchanger, thus the low melting point wax is not precipitated until the entire body of flowing mixture is cooled to its precipitation temperature. Consequently the precipitated wax is not sticky and does not tend to accumulate on the heat exchanger wall. Also, in plug flow radial mixing, the flowing mixture is directed at the heat exchanger wall, thus scouring any wax which may accumulate thereon. Additionally, with plug flow radial mixing in the cooling zones, wax tends to precipitate evenly throughout the flowing wax-oil-solvent mixtures such that mass transfer of precipitating wax from oil-solvent solution to an existing wax crystal is improved. Such improved mass transfer increases the growth rate of wax crystals and decreases the rate of wax crystal nuclei formation in the cooling zone.

For existing solvent dewaxing units employing double pipe heat exchangers, wherein refrigerant fluid is employed in the exchanger annuli for cooling oil-solvent mixtures, use of static mixers present an operational problem. The refrigerant fluid generally is substantially colder than the oil-solvent mixture with which it is exchanging heat. Consequently the heat exchanger walls is quite cold, relative to the temperature of the oil-solvent mixture and precipitated wax tends to stick to the cold walls. Plug flow radial mixing, by reducing transverse temperature gradients and by directing oil-solvent mixture flow to the walls, tends to reduce such wax accumulation. However, if the walls are too cold as a result of too great temperature difference between refrigerant fluid and oil-solvent mixture, wax will accumulate, thus reducing heat transfer and increasing pressure drop.

Plug flow radial mixing substantially increases heat transfer coefficient, in the range of 3 to 4 times the unmixed heat transfer rate. Therefore, in existing units, a retrofit with static mixers in the double pipe exchangers may also be accompanied by a reduction of temperature differential between the flowing oil-solvent mixture and refrigerant fluid. Reducing the temperature differential results in a relatively warmer exchanger wall at the same heat transfer rate, such that wax will not have such a tendency to accumulate, and the flow of oil-solvent mixture to the wall will wash away accumulated wax.

In many existing solvent dewaxing units, however, investment in refrigeration facilities is substantial, and changers in refrigerant fluid temperatures would require substantial revision. In such cases it may be desirable to maintain such use of scraped wall coolers or chillers in areas where wax accumulation upon the exchanger walls is severe. Even in these cases of existing solvent dewaxing units where changes to refrigeration systems would be costly, static mixers to provide plug flow radial mixing may be substituted for wall scrapers in heat exchangers which cool oil, oil-solvent mixtures to about the cloud point, for in these exchangers the refrigerant fluids are commonly water and/or cold solvent which may easily be adjusted to warmer temperatures. Also, in such units, static mixers may be used to advantage in heat exchangers wherein the flowing oil-solvent mixture is below about 30° F. (1° C.), for at these temperatures wax does not have a great tendency to accumulate upon the heat exchanger walls.

In the present application, an existing solvent dewaxing unit employing double pipe heat exchangers could be converted to the process of the present invention, without any substantial change in the refrigeration system, by employing static mixers in first cooling zone 6 and fourth cooling zone 18. Scraped wall exchangers may or may not be necessary in second cooling zone 10 and third cooling zone 14, depending upon the characteristics of the refrigeration system of the particular solvent dewaxing unit to be converted.

EXAMPLE

In order to demonstrate the process of the present invention, the following example is provided. A wax distillate oil of SAE-40 grade is dewaxed according to the process of the present invention. Physical properties of the SAE-40 grade oil are given in Table I, below:

TABLE I

| WAX DISTILLATE-SAE-40 GRADE PHYSICAL PROPERTIES | |
|---|---|
| Viscosity; SUS at 100° F | 878 |
| Viscosity, SUS at 210° F | 83.5 |
| Viscosity Index | 98 |
| Pour Point, ° F | 120+ |
| Wax Content, wt.% | 15.6 |
| API Gravity | 28.1 |

In the example process a stream of SAE-40 grade wax distillate is continuously diluted with dewaxing solvent comprising 55 volume percent methyl ethyl ketone(-MEK) and 45 volume percent toluene, in a volume ratio of 2:1 solvent to oil. Upon dilution, this first oil-solvent mixture is heated to 160° F. (71° C.) for melting all solid wax present and forming an oil-solvent-wax solution. The hot oil-solvent-wax solution is passed through a first indirect cooling zone comprising a double pipe heat exchanger fitted with Kenics (TM) mixers, wherein the oil-solvent-wax solution is cooled at a rate of 2.75° F./min (1.5° C./min) to a temperature of about 130° F. (55° C.) which is below the depressed cloud point of the solution.

From said first cooling zone, the first oil-solvent-wax mixture flows into a second cooling zone comprising a double pipe heat exchanger fitted with Kenics (TM) static mixers. Cold dewaxing solvent (55%) MEK, 45%) toluene), at a temperature of 65° F. (18° C.), in an amount equivalent to 0.5 volumes oil charge, is injected into said first oil-solvent-wax mixture via a nozzle comprising a restriction orifice at the inlet of said second cooling zone, forming a second oil-solvent-wax mixture. This second oil-solvent-wax mixture is cooled by indirect heat exchange in said second cooling zone at a rate of about 2.75° F./min (1.5° C./min) to a temperature of about 100° F. (38° C.).

From said second cooling zone, the second oil-solvent-wax mixture flows into a third cooling zone comprising a double pipe heat exchanger fitted with Kenics (TM) static mixers. Cold dewaxing solvent (55% MEK, 45% toluene), at a temperature of 65° F. (18° C.), is an amount equivalent to 0.5 volumes WD-50 charge, is injected into said second oil-solvent wax mixture via a nozzle comprising a restriction orifice at the inlet of said third cooling zone, forming a third oil-solvent-wax mixture. This third oil-solvent-wax mixture is cooled by indirect heat exchanger in said third cooling zone at a rate of about 2.75° F./min (15° C./min) to a temperature of about 75° F. (24° C.).

From said third cooling zone, the third oil-solvent-wax mixture flows into a third cooling zone comprising a double pipe heat exchanger fitted with Kenics (TM) static mixers. Cold dewaxing solvent (55% MEK, 45% toluene), at a temperature of 65° F. (18° C.), in an amount equivalent to 0.5 volumes oil charge, is injected into said third oil-solvent via a nozzle comprising a restriction orifice at the inlet of said fourth cooling zone, forming a fourth oil-solvent-wax mixture. This fourth oil-solvent-wax mixture is cooled by indirect heat exchange in said fourth cooling zone at a rate of about 2.75° F./min (1.5° C./min) to a temperature of about +2° F.

From the fourth cooling zone, the cold fourth oil-solvent-wax mixture is flowed to a vacuum filter, wherein wax is filtered from the oil-solvent mixture forming a filter cake. The filter cake is washed with cold dewaxing solvent for removing entrained oil therefrom, and the solvent washed filter cake is air dried for removing solvent. Operating conditions and results of this experiment are shown in runs 127 and 128 of Table II, below.

TABLE II

| Run No. | 127 | 128 | 113 | 134 |
|---|---|---|---|---|
| Initial dilution ratio (vol. solv/vol. oil) | 2.0 | 2.0 | 0 | 0.5 |
| Final dilution ratio (vol. solv/vol. oil) | 3.5 | 3.5 | 3.0 | 3.0 |
| Average Cooling rate (° F/min) | 2.75 | 2.64 | 4.0 | 3.93 |
| Filter Temperature (° F) | +2 | +2 | 0 | −2 |
| Dewaxed Oil Pour Pt. (° F) | +20 | +15 | +15 | +15 |
| Dewaxed Oil Yield (Vol.% charge) | 69.4 | 67.6 | 74.4 | 63.7 |
| Filter Capacity (gal. dewaxed oil/ ft²filter/hr) | 5.29 | 4.19 | 1.74 | 3.65 |

By way of comparison, SAE-40 grade charge (undiluted and diluted) is heated to about 160° F. (71° C.) for melting all the wax therein; then is mixed with 65° F. (18° C.) dewaxing solvent (55% MEK, 45%, toluene) under conditions of mixing with a turbine mixer at about 550 RPM to form an oil-solvent-wax mixture. This oil-solvent-wax mixture is then cooled by exchanger, at a cooling rate of about 4° F./min (202° C./min)) to a temperature of about 0° to −2° F. The cold oil-solvent-wax mixture from the scraped surface exchanger is then vacuum filtered to separate wax from the oil-solvent mixture. The separated wax, as a filter cake, is washed with cold solvent for removal of entrained oil, and subsequently is air dried for solvent removal. Results of these comparative examples are shown in runs 113 and 134 of Table II.

As can be seen from Table II, the process of the present invention yields about 67.6 vol.% dewaxed oil, at a +15° F. pour point (higher yield at higher pour point), with a filter dewaxed oil capacity of about 4.19 gal /ft² filter/hr. These results are obtained without use of rotating equipment such as agitator or scrapers. Comparing these results with those of Run 134, Table II, it is seen that dewaxed oil yield from the process of the present invention is higher (67.6 vol.% vs. 63.7 vol.%) at reasonable filter capacities (4.19 gal /ft²filter/hr vs. 3.65 gal. /ft² filter/hr). In Run 113, Table II, the dewaxed oil yield is high (74.4 vol.% vs. 67.6 vol.%), but the filter capacity is severly restricted (1.74 gal /ft$^2$ filter/hr. vs. 4.19 gal /ft$^2$ filter/hr.). Thus, the process of the present invention produces a good yield of dewaxed oil with good wax filter capacity, compared to processes using rotating equipment such as agitators and scrapers.

We claim, and wish to protect by letters patent:

1. In a continuous solvent dewaxing process wherein a heavy waxy petroleum oil charge selected from distillate or residual oil stocks, is diluted with solvent to form an oil-solvent mixture having all wax dissolved therein, wherein the oil-solvent mixture is cooled to a selected separation temperature for precipitating wax crystals and forming a wax/oil/solvent mixture, wherein wax is separated from such wax/oil/solvent mixture in a solid-liquid separation zone, forming a solid wax cake and a wax free oil-solvent mixture, and wherein the wax free oil-solvent mixture is fractionated, in a fractionation zone to yield a solvent stream and a dewaxed oil product stream; the improvement which comprises:

(a) cooling, in a first elongated tubular cooling zone, a liquid mixture of waxy oil stock prediluted with dewaxing solvent, said liquid mixture having a volume ratio of solvent to oil in the range of 1:1 to 2.5:1 and an initial temperature in the range of 130° to 180° F., at a cooling rate of about 1°–8° F./min. to a temperature about 0°–10° F. below the depressed cloud point of the oil/solvent mixture, under conditions of plug flow radial mixing, for precipitating wax and forming a first wax crystal-/oil/solvent mixture;

(b) cooling, in a second elongated tubular cooling zone, said first wax/oil/solvent mixture and a first portion of dilution solvent equivalent to about 0.3 to 0.7 volumes of waxy oil charge, at a cooling rate of 1°–8° F./min, to a temperature in the range of about 50°–100° F. for precipitating additional wax and forming a second wax crystal/oil/solvent mixture;

(c) cooling, in a third elongated tubular cooling zone, said second wax/oil/solvent mixture and a second portion of dilution solvent equivalent to about 0.3 to 0.7 volumes of waxy oil charge, at a cooling rate of 1°–8° F./min, to a temperature in the range of about 10°–75° F. for precipitating additional wax and forming a third wax crystal/oil/solvent mixture;

(d) cooling, in a fourth elongated tubular cooling zone, said third wax/oil/solvent mixture and a third portion of dilution solvent equivalent to about 0.3 to 1.5 volumes of waxy oil charge, at a cooling rate of about 1°–8° F./min, under conditions of plug flow radial mixing to a selected separation temperature in the range of about +15° F. to about −15° F. for precipitating additional wax and forming a fourth wax crystal/oil/solvent mixture;

(e) flowing said fourth wax crystal/oil/solvent mixture from said fourth cooling zone to said solid-liquid separation zone.

2. The process of claim 1, wherein the cooling rates in said second, third, and fourth cooling zones are in the range of about 1.5 to 5° F./min.

3. The process of claim 2, wherein the flow velocities of said wax/oil/solvent mixtures in said first, second, third, and fourth cooling zones are equivalent to about 0.5 to 8 cooling zone diameters per second.

4. The process of claim 3, wherein each portion of dilution solvent is injected a fine liquid droplet into the respective first, second, and third wax/oil/solvent mixture near the inlet of the respective second, third and fourth cooling zone, and wherein each portion of dilution solvent is thoroughly mixed with the respective wax/oil/solvent mixture in the respective cooling zone.

5. The process of claim 4, wherein mixing of dilution solvent with wax/oil/solvent mixture in second and third cooling zones is under conditions of plug flow radial mixing.

6. The process of claim 5 wherein cooling in said first, second, third, and fourth cooling zones is by indirect heat exchange with a refrigerant fluid.

7. The process of claim 6, wherein the temperature of each first, second, and third portion of dilution solvent is below the temperature of the respective first, second, and third wax crystal/oil/solvent mixture at the point of solvent injection.

8. The process of claim 7, wherein said first portion of dilution solvent has a temperature in the range of about 40°–90° F., wherein the temperature of said second portion of dilution solvent has a temperature in the range of about 40°–90° F., and wherein said third portion of dilution solvent has a temperature in the range of about −20° to +20° F.

9. The process of claim 8, wherein dewaxing solvent comprises about 30–70 vol.% methylethyl ketone and 70–30 vol.% toluene.

* * * * *